US005327873A

United States Patent [19]

Ohuchi et al.

[11] Patent Number: 5,327,873

[45] Date of Patent: Jul. 12, 1994

[54] MALFUNCTION SENSING APPARATUS FOR A FUEL VAPOR CONTROL SYSTEM

[75] Inventors: Hirofumi Ohuchi; Shinya Fujimoto, both of Himeji, Japan

[73] Assignee: Mitsubishi Denki Kabushiki Kaisha, Tokyo, Japan

[21] Appl. No.: 111,493

[22] Filed: Aug. 25, 1993

[30] Foreign Application Priority Data

Aug. 27, 1992 [JP] Japan ..... 4-228795

[51] Int. Cl.[5] ..... F02M 33/02

[52] U.S. Cl. ..... 123/520; 123/198 D

[58] Field of Search ..... 123/198 D, 518, 519, 123/520

[56] References Cited

U.S. PATENT DOCUMENTS

| | | | |
|---|---|---|---|
| 4,949,695 | 8/1990 | Uranishi et al. | 123/520 |
| 5,143,035 | 9/1992 | Kayanuma | 123/198 D |
| 5,146,902 | 9/1992 | Cook et al. | 123/520 |
| 5,193,512 | 3/1993 | Steinbrenner | 123/519 |
| 5,199,442 | 3/1993 | Blumenstock et al. | 123/520 |
| 5,220,896 | 6/1993 | Blumenstock et al. | 123/198 D |
| 5,230,319 | 7/1993 | Otsuka et al. | 123/198 D |
| 5,245,973 | 9/1993 | Otsuka et al. | 123/518 |
| 5,261,379 | 11/1993 | Lipinski et al. | 123/520 |
| 5,265,577 | 11/1993 | Denz et al. | 123/198 D |
| 5,269,277 | 12/1993 | Kuroda et al. | 123/198 D |

OTHER PUBLICATIONS

California Air Resources Board, Technical Support Document, Jul. 26, 1991, columns 11–15.

*Primary Examiner*—E. Rollins Cross
*Assistant Examiner*—Thomas N. Moulis
*Attorney, Agent, or Firm*—Sughrue, Mion, Zinn, Macpeak & Seas

[57] ABSTRACT

A malfunction sensing apparatus for a fuel vapor control system includes a fuel tank and a canister containing an adsorbent for adsorbing fuel vapor. The canister has an inlet connected to the fuel tank and an outlet. A purge control valve is connected to the outlet for connecting and disconnecting the outlet of the canister from the air intake pipe of an engine. A pressure sensor senses the internal pressure of the fuel tank. A malfunction sensing means responsive to the pressure sensor senses a malfunction when the purge control valve is open and the pressure sensed by the pressure sensor is above a prescribed value. A prohibiting means senses the rate of change and/or the magnitude of the pressure sensed by the pressure sensor with the purge control valve closed and prohibits malfunction sensing by the malfunction sensing means when the rate of change of the pressure exceeds a prescribed rate and/or the magnitude of the pressure exceeds a prescribed value.

10 Claims, 7 Drawing Sheets

PURGE CONTROL VALVE
OPEN
CLOSED

CANISTER CLOSE VALVE
CLOSED
OPEN

INTERNAL PRESSURE OF APPARATUS
HIGH
LOW
※ MUCH FUEL VAPOR
※ ABNORMAL
NORMAL
TIME t

PURGE CONTROL VALVE
OPEN
CLOSED
B

CANISTER CLOSE VALVE
OPEN
CLOSED
FUEL VAPOR PRESENT

INTERNAL PRESSURE OF APPARATUS
HIGH
LOW
NO FUEL VAPOR

TIMING OF PRESSURE SAMPLING
A
TIME t

CHECK VALVE OPERATION

MALFUNCTION SENSING APPARATUS FOR A FUEL VAPOR CONTROL SYSTEM

BACKGROUND OF THE INVENTION

This invention relates to a malfunction sensing apparatus which can sense malfunctions in a fuel vapor control system for an internal combustion engine.

An internal combustion engine for a vehicle, such as an automobile, is generally supplied with fuel from a fuel tank mounted on the vehicle. When the vehicle is stationary for long periods, fuel vapors are generated by the fuel within the fuel tank. In order to prevent these vapors, which may contain harmful hydrocarbon components, from escaping to the atmosphere and becoming a source of air pollution, modern automobiles are commonly equipped with a fuel vapor control system which adsorbs the fuel vapors from the fuel tank when the engine is off and then supplies the fuel vapors to the engine for combustion when the engine is running.

A typical fuel vapor control system for an automotive vehicle includes a canister containing an adsorbent such as activated charcoal. The canister has an inlet connected to the fuel tank of the vehicle and an outlet connected to the air intake pipe of the engine of the vehicle. When the engine is off, fuel vapors travel through from the fuel tank into the charcoal canister and are adsorbed. When the engine is turned on, the intake manifold vacuum sucks the adsorbed vapors out of the charcoal canister and into the engine for combustion. The charcoal canister generally includes a portion that is open to the atmosphere so that the intake manifold vacuum causes atmospheric air to sweep through the canister and purge the charcoal of the adsorbed fuel vapors.

When there is a malfunction of the fuel vapor control system, such as a breakage of tubing between the fuel tank and the charcoal canister or between the canister and the engine, deterioration of the charcoal canister, or the like, fuel vapors can escape to the atmosphere, thereby defeating the purpose of the fuel vapor control system. Therefore, a malfunction sensing device has been proposed in order to detect such malfunctions and generate a warning to alert a driver of the vehicle of the problem so that he can have the fuel vapor control system repaired. In one malfunction sensing apparatus which has been proposed, the internal pressure of the fuel tank is monitored. During engine operation, if the fuel vapor control system is operating normally, a negative pressure should develop within the fuel tank due to the intake manifold vacuum of the engine, since the fuel tank communicates with the air intake pipe via the fuel vapor control system. In contrast, if there is a leak to the atmosphere or similar problem in the fuel vapor control system, only a very slight negative pressure will be produced in the fuel tank. Therefore, when the pressure in the fuel tank does not fall to a suitable level when the engine is running, it is determined that there is a malfunction in the fuel vapor control system.

However, under certain conditions, such as when the outside air temperature is high, the vapor pressure of the fuel in the fuel tank will be quite high. Therefore, when the engine is running, the presence of the fuel vapor in the fuel tank will prevent the pressure in the fuel tank from exhibiting the decrease indicative of normal operation. As a result, even though the fuel vapor control system is actually functioning normally, a conventional malfunction sensing apparatus will mistakenly determine that it is malfunctioning and will generate a warning, which can cause confusion, trouble, and expense for the driver of the vehicle.

SUMMARY OF THE INVENTION

Accordingly, it is an object of the present invention to provide a malfunction sensing apparatus which can reliably sense malfunctions of a fuel vapor control system for an internal combustion engine.

It is a more specific object of the present invention to provide a malfunction sensing apparatus for a fuel vapor control system which does not give false indications of a malfunction under conditions in which the vapor pressure in a fuel tank is high.

It is another object of the present invention to provide a malfunction sensing method for a fuel vapor control system.

A malfunction sensing apparatus for a fuel vapor control system according to one form of the present invention includes a source of fuel vapor, such as a fuel tank, and a canister containing an adsorbent. The canister has an inlet connected to the source of fuel vapor and an outlet. A purge control valve is connected to the outlet for connecting and disconnecting the outlet of the canister from the air intake pipe of an engine. A pressure sensor senses the internal pressure of the source of fuel vapor. A malfunction sensing means responsive to the pressure sensor senses a malfunction when the purge control valve is open and the pressure sensed by the pressure sensor is above a prescribed value. A prohibiting means senses the rate of change and/or the magnitude of the pressure sensed by the pressure sensor when the purge control valve is closed and prohibits malfunction sensing by the malfunction sensing means when the rate of change of the pressure exceeds a prescribed rate and/or the magnitude of the pressure exceeds a prescribed value.

In a malfunction sensing apparatus according to another form of the present invention, a check valve having a prescribed operating pressure is provided between a source of fuel vapor and a canister. A prohibiting means prohibits malfunction sensing by a malfunction sensing means when the internal pressure of the source of fuel vapor exceeds the operating pressure of the check valve, or when the rate of change of the internal pressure of the source of fuel vapor exceeds a prescribed rate and/or the magnitude of the internal pressure exceeds a prescribed value.

A malfunction sensing method according for a fuel vapor control system according to the present invention includes isolating a source of fuel vapor from an engine so that fuel vapor generated in the fuel vapor source can not flow to the engine. The internal pressure of the fuel vapor source is sensed, and the rate of increase and/or the magnitude of the internal pressure of the fuel vapor source with the fuel vapor source in an isolated state is determined. Malfunction sensing is then performed only if the rate of increase and/or the magnitude of the internal pressure is below a prescribed value.

A malfunction sensing apparatus according to the present invention prohibits malfunction sensing when the internal pressure characteristics of the source of fuel vapor indicate the presence of a large amount of fuel vapor in the fuel vapor source. Under these pressure conditions, there is the possibility of mistaken sensing of malfunctions, so by prohibiting malfunction sensing when these conditions exist, the reliability of malfunction sensing can be greatly increased.

A malfunction sensing apparatus according to the present invention is particularly suitable for use with a fuel vapor control system for an automotive vehicle. However, it can be used with fuel vapor control systems for other types of vehicles, such as boats or farm equipment. Furthermore, it is not limited to use with vehicles, and can be used with a fuel vapor control system for any internal combustion engine.

DESCRIPTION OF THE PREFERRED EMBODIMENTS

Figure 1:
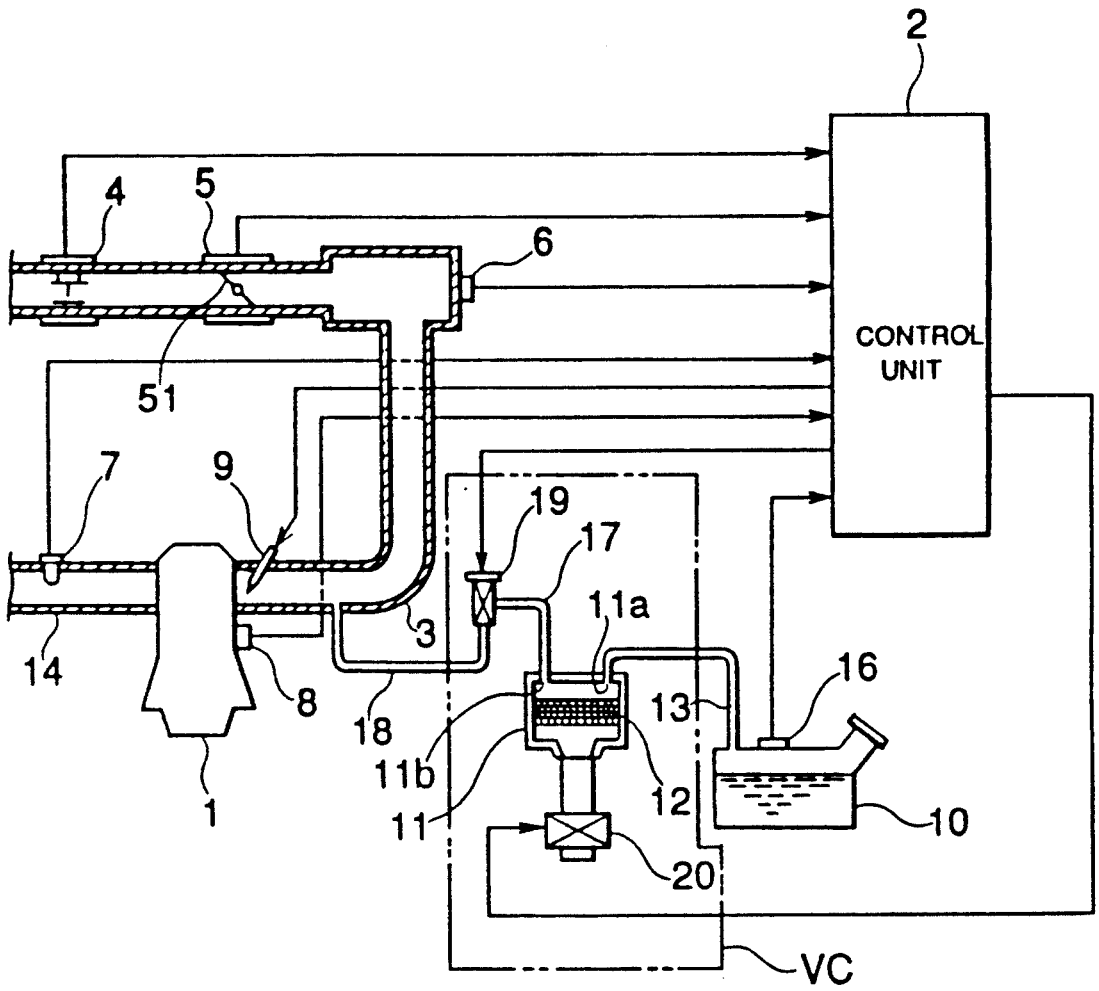
FIG. 1 is a schematic illustration of a first embodiment of a malfunction sensing apparatus according to the present invention.

A number of preferred embodiments of a malfunction sensing apparatus for a fuel vapor control system will now be described while referring to the accompanying drawings. FIG. 1 illustrates a first embodiment applied to an internal combustion engine 1 of an automotive vehicle. The engine 1, which has one or more cylinders and can be of conventional structure, is equipped with an air intake pipe 3 on which are installed an air flow meter 4 (such as a heat-sensitive flow meter) for measuring the air intake amount of the engine, 1 a throttle opening sensor 5 that senses the degree of opening of a throttle valve 51 mounted in the air intake pipe 3, an air intake pressure sensor 6 that senses the pressure in the air intake pipe 3, and one or more fuel injectors 9 for providing fuel to the engine 1. An exhaust gas sensor 7 that senses the concentration of oxygen in the exhaust gas of the engine is installed on the exhaust manifold 14 of the engine 1. A rotational speed sensor 8 is mounted on the engine 1 for sensing the engine rotational speed. Sensors 4–8 can all be of conventional designs.

Each of sensors 4–8 generates an electrical output signal corresponding to the sensed parameter, and these signals are provided to an electronic control unit 2, such as a microcomputer. The control unit 2 typically includes an input portion for receiving analog and digital input signals, a CPU, and an output portion which generates drive signals for various loads. Based on the input signals, the control unit 2 calculates a fuel injection amount for the fuel injectors 9 and performs feedback control of the fuel injectors 9 so as to obtain a desired air-fuel ratio in the engine 1. The control unit 2 also calculates a suitable ignition timing based on the present operating conditions of the vehicle and controls an unillustrated ignition system for the engine according to the calculated ignition timing. Algorithms for calculating fuel injection amounts and ignition timing by an electronic control unit are well known in the art, and any suitable algorithms can be employed.

The vehicle is equipped with a fuel tank 10 which provides fuel to the fuel injectors 9 via an unillustrated fuel supply system, which can be of conventional structure. The fuel tank 10 acts as a source of fuel vapors, which evaporate from the fuel within the fuel tank 10. Fuel vapors which are generated within the fuel tank 10 are prevented from being released to the atmosphere by a fuel vapor control system VC. This system VC includes a canister 11 packed with an adsorbent 12 for fuel vapors such as activated carbon. Fuel vapor which is generated within the fuel tank 10 is introduced into the canister 11 by a fuel vapor introduction passage 13 connected between the fuel tank 10 and an inlet **11*a* of the canister 11. The canister 11 also includes an outlet 11*b* which is connected to the air intake pipe 3 of the engine 1 at a location downstream of the throttle valve 51 by fuel vapor supply passages 17 and 18, which are connected to one another by a purge control valve 19. The purge control valve 19 is opened and closed by a control signal from the control unit 2. The canister 11 is further equipped with a canister close valve 20 which is opened and closed by a control signal from the control unit 2. When the canister close valve 20 is opened, the inside of the canister 11 communicates with the atmosphere so that air can be drawn into the canister 11 by the intake manifold vacuum to purge the canister 11 of adsorbed fuel vapors. When valve 20 is closed, the canister 11** is sealed off from the atmosphere.

A pressure sensor 16 is mounted on the fuel tank 10 for sensing the pressure of vapors within the fuel tank 10 and therefore the internal pressure of the fuel vapor control system VC. The sensor 16 generates an electrical output signal which is indicative of the sensed pressure and which is provided to the control unit 2. Based on the magnitude of the pressure sensed by the pressure sensor 16 when valve 19 is open, the control unit 2 performs malfunction sensing to determine whether there is a malfunction within the fuel vapor control system VC. Furthermore, based on the rate of change and/or the magnitude of the pressure sensed by the pressure sensor 16 when valves 19 and 20 are closed, the control unit 2 determines whether conditions are suitable for performing malfunction sensing.

When the purge control valve 19 is closed, fuel vapors generated within the fuel tank 10 travel through the fuel vapor introduction passage 13 to the canister 11 and are adsorbed by the adsorbent 12 and thus prevented from escaping to the atmosphere. When the engine 1 is running and the control unit 2 determines based on the input signals from sensors 4–8 that operating conditions are suitable for supplying fuel vapor to the engine 1, the purge control valve 19 and the canister control valve 20 are opened by the control unit 2. The intake manifold vacuum is communicated with the inside of the canister 11 through the purge control valve 19, so air from the atmosphere is sucked into the canister 11 through the canister close valve 20 and then into the air intake pipe 3 through the purge control valve 19. As the air passes through the canister 11, it purges the adsorbent 12 of the fuel vapors which were previously adsorbed by the adsorbent 12, and these fuel vapors are carried with the air into the air intake pipe 3 to be combusted in the engine 1. The control unit 2 determines the conditions for opening and closing the purge control valve 19 based on well-known algorithms so as to maintain a desired air-fuel ratio.

Figures 2A, 2B, 2C:
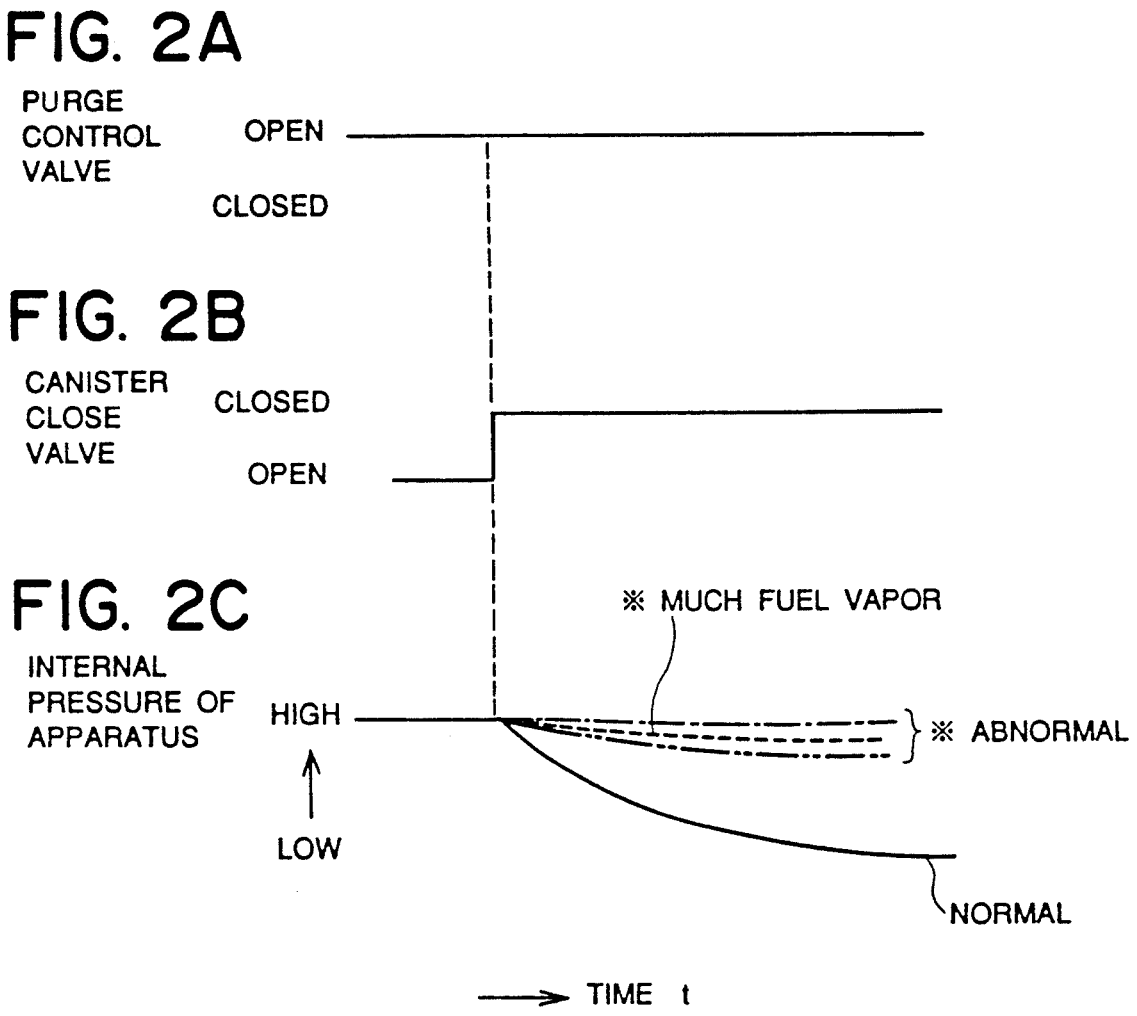
FIGS. 2A–2C are timing diagrams showing the variation of the pressure of the fuel tank during malfunction sensing.

FIGS. 2A-2C illustrate the states of valves 19 and 20 and the internal pressure of the fuel tank 10 during malfunction sensing. In order to perform malfunction sensing, the control unit 2 closes the canister close valve 20 while maintaining the purge control valve 19 open. In this state, if there are no abnormalities such as leaks in the fuel vapor control system VC, the pressure in the fuel tank 10 sensed by the pressure sensor 16 will be expected to decrease as shown by the solid line in FIG. 2C due to the intake manifold vacuum acting on the inside of the fuel tank 10. In contrast, if there are leaks in the fuel vapor control system VC, the pressure within the fuel tank 10 will undergo little or no decrease, as indicated by the dashed lines in the figure. Therefore, upon the closing of the canister close valve 20, if the magnitude of the decrease in the pressure sensed by the pressure sensor 16 is less than a predetermined amount, the control unit 2 determines that there is an abnormality in the fuel vapor control system VC and generates a warning, such as by activating an unillustrated warning light.

However, as shown by the middle of the three dashed lines in FIG. 2C, when there is much fuel vapor generated in the fuel tank 10, the pressure sensed by the pressure sensor 16 will not decrease by the prescribed amount, even though the fuel vapor control system is functioning normally. Therefore, in order to prevent this condition from being mistaken for a system malfunction, the control unit 2 determines whether conditions are suitable for malfunction sensing, and if much fuel vapor is being generated in the fuel tank 10, the control unit 2 does not perform malfunction sensing.

Figure 3:
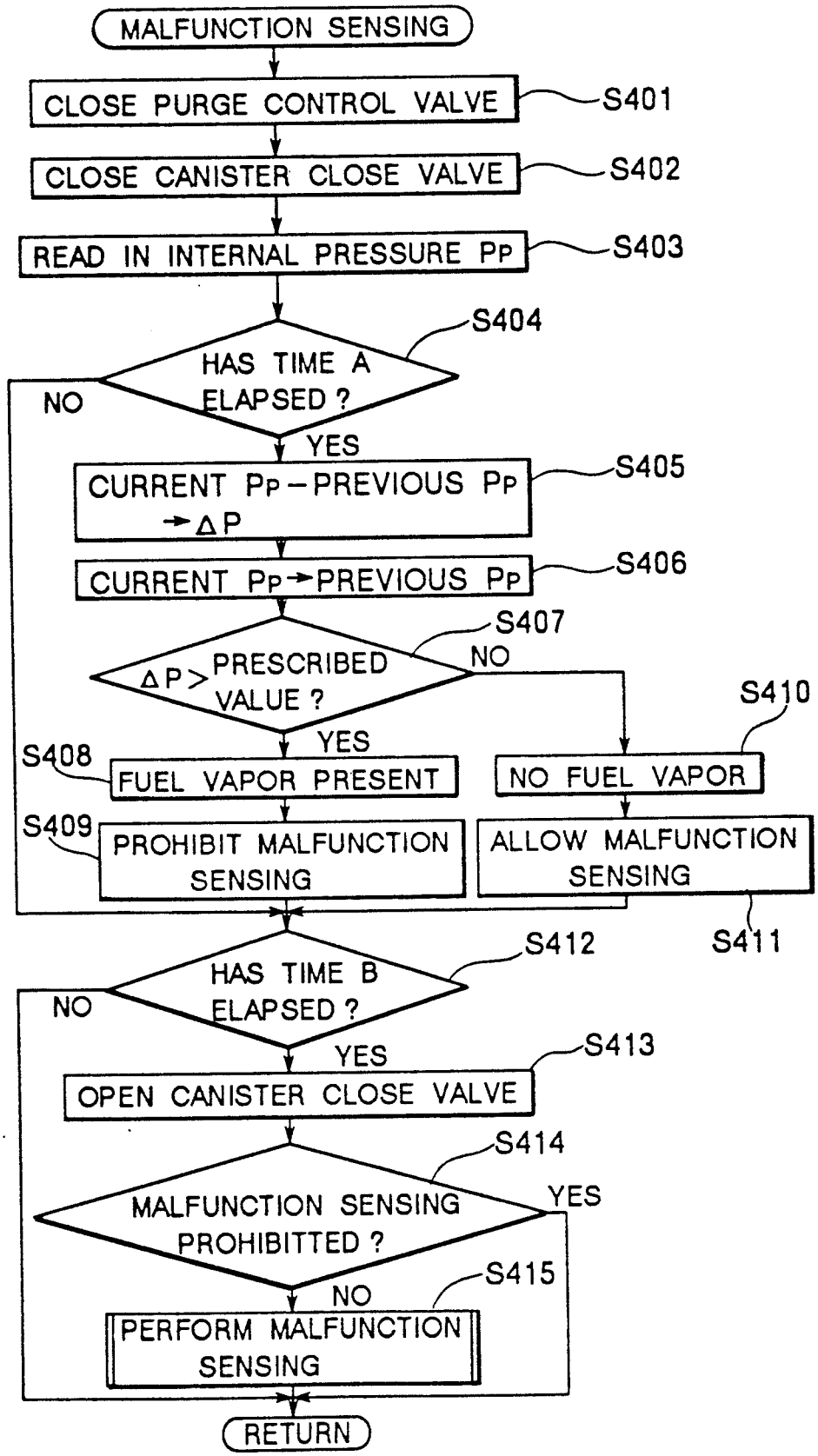
FIG. 3 is a flow chart of a malfunction sensing routine performed by the embodiment of FIG. 1.
Figures 4A, 4B, 4C, 4D:
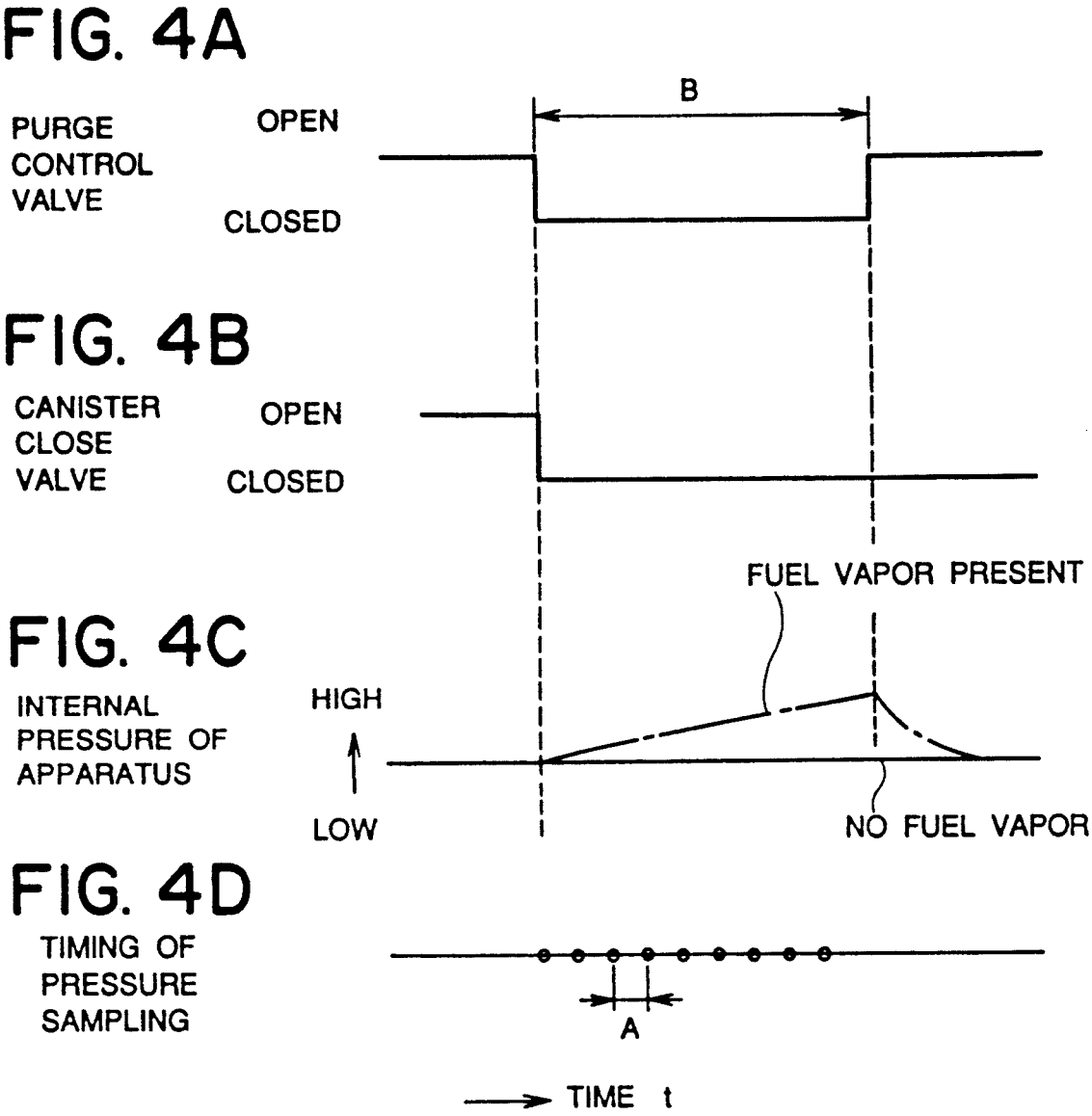
FIGS. 4A–4D are timing diagrams of the operation of the embodiment of FIG. 1.

FIG. 3 is a flow chart of a malfunction sensing routine performed by the control unit 2 of the embodiment of FIG. 1. The illustrated routine is repeated at prescribed intervals, such as every 20 sec. First, in Step S401, the purge control valve 19 is closed, and in Step S402, the canister close valve 20 is also closed, thereby isolating the fuel tank 10 and the canister 11 from both the atmosphere and the engine 1. At this time, valves 19 and 20 assume the states shown by FIGS. 4A and 4B. In Step S403, the internal pressure Pp within the fuel tank 10 is read in from the pressure sensor 16. In Step S404, it is determined whether a prescribed period of time A, such as 0.5 seconds, has elapsed.

If period A has not elapsed, then the routine proceeds to Step S412. If period A has elapsed, then the difference between the value of Pp measured in the most recent execution of Step S403 and the previous value of Pp measured the previous execution of Step S403 is calculated. If this is the first pass through the routine, the present and previous values of Pp are calculated as being the same, so the difference is set equal to 0. In Step S406, the present value of the pressure Pp is stored in a memory of the control unit 2 as the previous value.

In Step S407, it is determined whether the pressure difference calculated in Step S405 is greater than a prescribed value. This pressure difference is the change in the internal pressure of the fuel tank 10 within period A and therefore is indicative of the rate of increase of the internal pressure. If there is little or no fuel vapor present within the fuel tank 10, the pressure within the fuel tank 10 will remain substantially constant when valves 19 and 20 are closed, as shown by the solid line in FIG. 4C. However, if there is considerable fuel vapor being generated in the fuel tank 10, the internal pressure of the fuel tank 10 will increase as shown by the dashed line in FIG. 4C when valves 19 and 20 are closed.

Thus, if it is determined in Step S407 that the pressure difference is less than or equal to the prescribed value, Step S410 is proceeded to, and it is determined that there is no fuel vapor present in the fuel tank 10 or else that the amount present is so small that it has no effect on malfunction sensing. In Step S411, a flag is set in the memory of the control unit 2 to indicate that malfunction sensing is permitted.

In contrast, if in Step S407 the pressure difference is greater than the prescribed value, then Step S408 is proceeded to, and it is determined that enough fuel vapor is being generated in the fuel tank 10 to interfere with proper sensing of malfunctions. Therefore, in Step S409, a memory flag is set to prohibit malfunction sensing.

Step S412 is then proceeded to, and it is determined whether a prescribed period of time B such as 20 seconds (B>A) has elapsed. If period B has not elapsed, then a return is performed. However, if period B has elapsed without the pressure difference having exceeded the prescribed value, then malfunction sensing is permitted. Therefore, in Step S413, the canister close valve 20 is opened, and in Step S414, the memory flag is checked to see whether it indicates that malfunction sensing is permitted. If it was determined in Step S409 that malfunction sensing is prohibited, then a return is performed from Step S414 without performing malfunction sensing. However, if it was determined in Step S411 that malfunction sensing is permitted, then in Step S415, malfunction sensing is performed in the manner described above with respect to FIGS. 2A-2C. Namely, the purge control valve 19 is opened and the canister close valve 20 is closed, and the internal pressure of the fuel tank 10 is monitored to see if it falls to a prescribed level indicating normal operation.

As a result of the routine illustrated in FIG. 3, malfunction sensing is not performed under conditions in which the presence of fuel vapor in the fuel tank 10 could interfere with accurate sensing. Therefore, the reliability of malfunction sensing is greatly increased.

In the routine of FIG. 3, malfunction sensing is prohibited when the rate of pressure increase within the fuel tank 10 exceeds a prescribed value. However, it is instead possible to prohibit malfunction sensing when the magnitude of the internal pressure sensed by the pressure sensor 16 exceeds a prescribed value. Furthermore, the routine can be modified so that both the rate of pressure increase and the magnitude of the pressure is monitored and so that malfunction sensing is prohibited when either the rate of increase exceeds a prescribed rate or the internal pressure exceeds a prescribed pressure.

Figure 5:
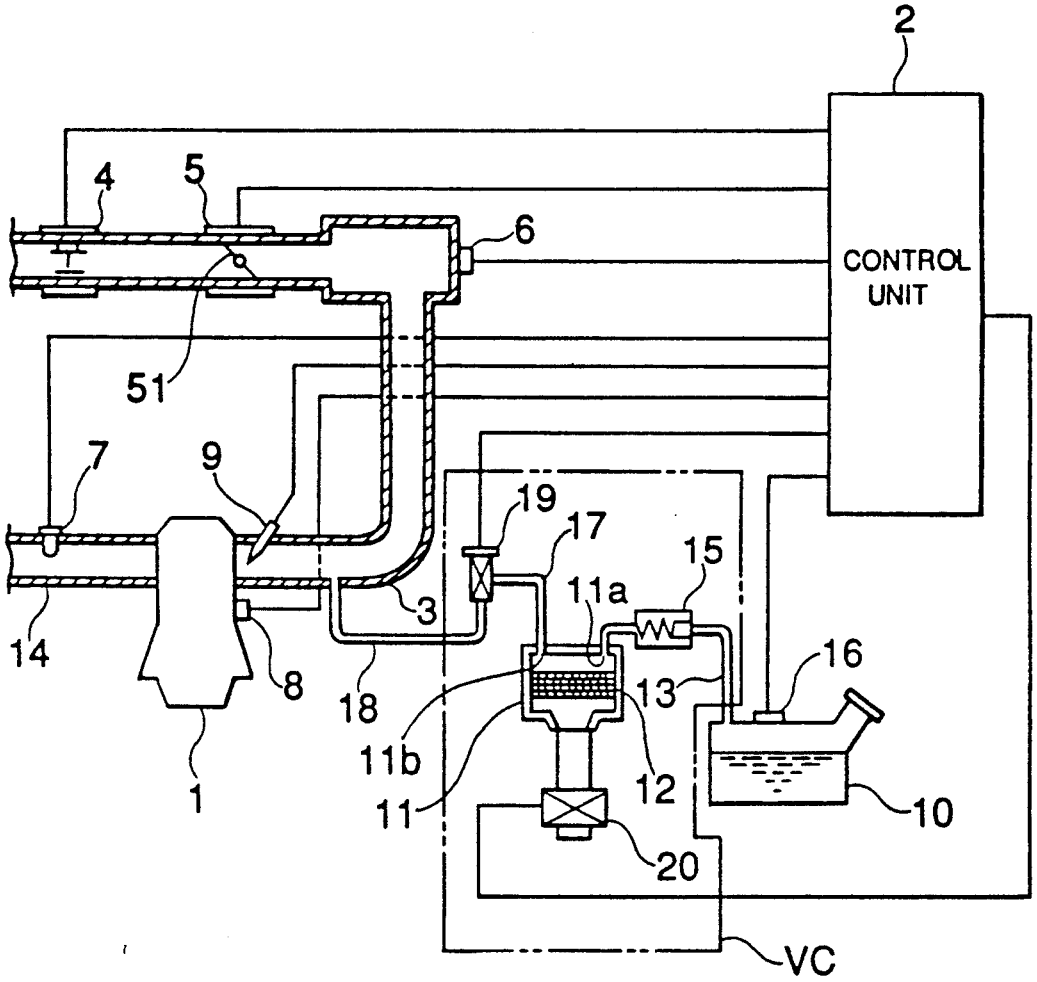
FIG. 5 is a schematic illustration of a second embodiment of the present invention.

FIG. 5 illustrates another embodiment of the present invention in which a fuel vapor control system VC for an engine 1 is equipped with a check valve 15 installed in the fuel vapor introduction passage 13 between a fuel tank 10 and a canister 11. The check valve 15 prevents fluids from flowing backwards from the canister 11 into the fuel tank 10 and restricts the flow rate of fluid vapors from the fuel tank 10 to the canister 11. The operation of the control unit 2 of this embodiment is somewhat different from that of the control unit 2 of FIG. 1, but the structure of this embodiment is otherwise the same as the embodiment of FIG. 1.

Figures 6A, 6B:
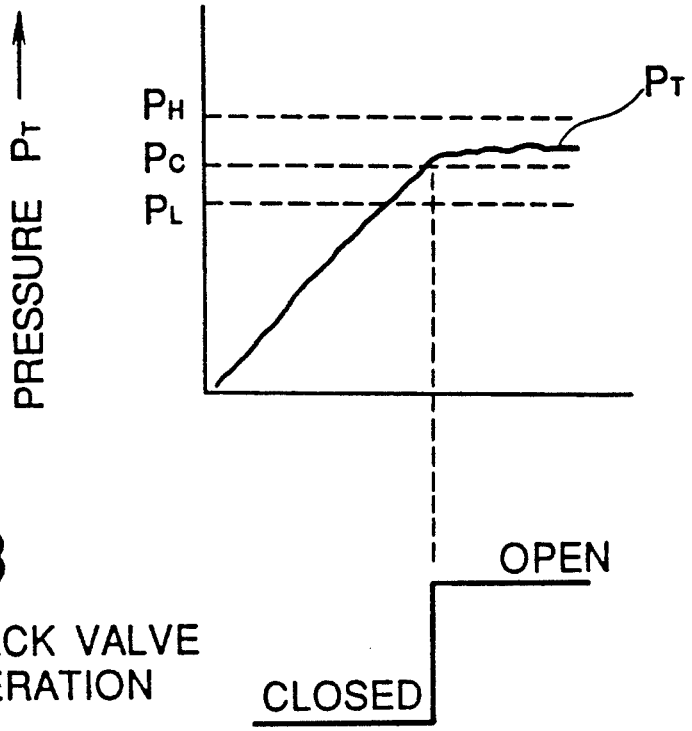
FIGS. 6A and 6B are timing diagrams illustrating the operation of the check valve of FIG. 5.

FIGS. 6A and 6B illustrate the operating characteristics of the check valve 15. It has a rated operating pressure $P_c$, which can vary in a range between $P_H$ and $P_L$. When the pressure Pt within the fuel tank 10 reaches the operating pressure, the check valve 15 opens, as shown by FIG. 6B, to permit fuel vapor to flow into the canister 11.

Figure 7:
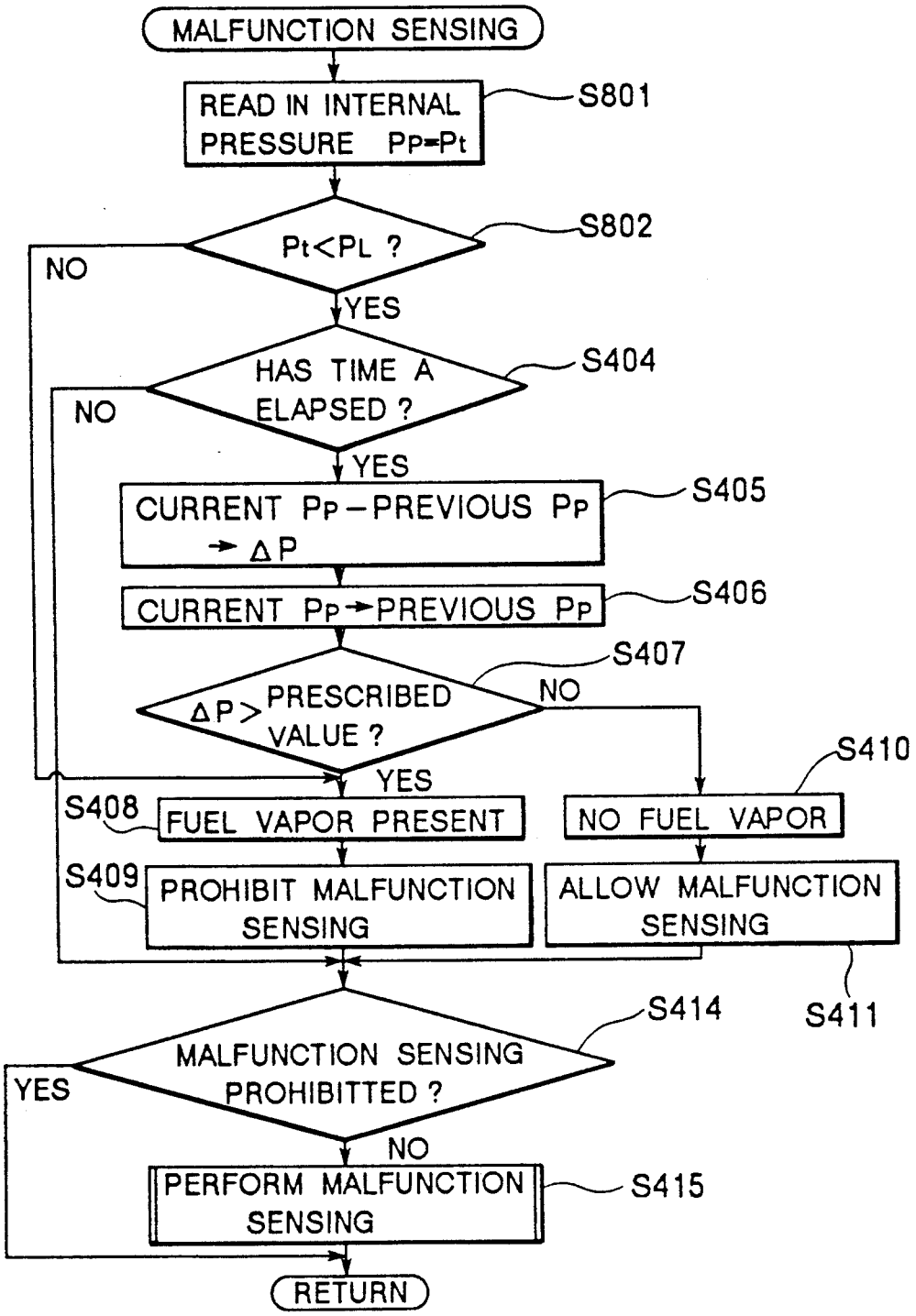
FIG. 7 is a flow chart of a malfunction sensing routine performed by the embodiment of FIG. 5.

FIG. 7 is a flow chart of a malfunction sensing routine performed by the control unit 2 of the embodiment of FIG. 5. In Step S801, the internal pressure Pt=Pp of the fuel tank 10 is read in from the pressure sensor 16. In Step S802, Pt is compared with the lower limit $P_L$ of the operating pressure $P_C$ of the check valve 15. If Pt is greater than or equal to $P_L$, Step S408 is proceeded to, and it is determined that there is a large amount of fuel vapor being generated in the fuel tank 10, so in Step S409, malfunction sensing is prohibited. On the other hand, if the internal pressure Pt is less than $P_L$, then Step S404-407 are performed to determine if the rate of increase of the pressure within the fuel tank 10 is greater than a prescribed rate, in the same manner as in the routine of FIG. 3. If the rate of increase is greater than the prescribed rate, then malfunction sensing is prohibited, just as in the previous embodiment. In Step S414, it is determined whether malfunction sensing was prohibited in Step S409. If it was prohibited, then a return is performed, while if malfunction sensing is permitted, then Step S415 is performed, and malfunction sensing is carried out in the manner described above with respect to FIGS. 2A-2C.

Thus, in this embodiment, malfunction sensing is prohibited when either the internal pressure Pt of the fuel tank 10 is greater than or equal to the operating pressure of the check valve 10 or when the check valve 15 is closed and the rate of increase of pressure within the fuel tank 10 is above a prescribed level. Instead of or in addition to measuring the rate of increase of pressure within the fuel tank 10, it is possible to measure the magnitude of the pressure within the fuel tank 10 to determine when malfunction sensing should be prohibited. Namely, it can be determined that malfunction sensing should be prohibited when the internal pressure of the fuel tank 10 is above a prescribed value with the check valve 15 closed.

In the embodiment of FIG. 5, the fuel tank 10 is isolated from the atmosphere when the check valve 15 is closed, so it is not necessary to close the canister close valve 20 when measuring the pressure within the fuel tank 10. Therefore, Steps S402 and S413 are not necessary in the routine of FIG. 7.

Furthermore Step S412 of the routine of FIG. 3 is necessary for checking the variation in pressure within a prescribed period of time B, but in the embodiment of FIG. 5, pressure variations are constantly checked, so this step is not necessary in the routine of FIG. 7.

What is claimed is:

1. A malfunction sensing apparatus for a fuel vapor control system for an internal combustion engine comprising:

a source of fuel vapor;

a canister containing an adsorbent for adsorbing fuel vapor and having an inlet connected to the source of fuel vapor and an outlet;

a purge control valve connected to the outlet;

a pressure sensor for sensing a pressure of the source of fuel vapor;

malfunction sensing means responsive to the pressure sensor for sensing a malfunction when the purge control valve is open and the pressure sensed by the pressure sensor is above a prescribed value; and prohibiting means for sensing a rate of change of the pressure sensed by the pressure sensor with the purge control valve closed and prohibiting malfunction sensing by the malfunction sensing means when the rate of change of the pressure exceeds a prescribed rate.

2. An apparatus as claimed in claim 1 wherein the source of fuel vapor comprises a fuel tank for an engine.

3. An apparatus as claimed in claim 1 including a canister closing valve for opening and closing the canister with respect to the atmosphere, wherein the prohibiting means senses the rate of change of the pressure with the canister closing valve closed.

4. An apparatus as claimed in claim 1 wherein the prohibiting means prohibits malfunction sensing by the malfunction sensing means when the pressure sensed by the pressure sensor exceeds a prescribed value.

5. A malfunction sensing apparatus for a fuel vapor control system comprising:

a source of fuel vapor;

a canister containing an adsorbent for adsorbing fuel vapor and having an inlet and an outlet;

a check valve connected between the source of fuel vapor and the inlet of the canister and having an operating pressure at which the check valve opens;

a pressure sensor for sensing a pressure of the source of fuel vapor;

malfunction sensing means responsive to the pressure sensor for sensing a malfunction when the pressure sensed by the pressure sensor is above a prescribed value; and prohibiting means for prohibiting malfunction sensing by the malfunction sensing means when the pressure sensed by the pressure sensor is greater than the operating pressure of the check valve.

6. An apparatus as claimed in claim 5 wherein the prohibiting means includes means for prohibiting malfunction sensing when the pressure sensed by the pressure sensor is less than the operating pressure of the check valve and a rate of change of the pressure is above a prescribed rate.

7. An apparatus as claimed in claim 5 wherein the prohibiting means prohibits malfunction sensing by the malfunction sensing means when the pressure sensed by the pressure sensor exceeds a prescribed value.

8. An apparatus as claimed in claim 6 wherein the prohibiting means prohibits malfunction sensing by the malfunction sensing means when the pressure sensed by the pressure sensor exceeds a prescribed value.

9. A malfunction sensing method for a fuel vapor control system, the fuel vapor control system comprising a canister containing an adsorbent and having an inlet connected to a fuel vapor source and an outlet connected to an internal combustion engine, the method comprising:

isolating the fuel vapor source from the engine so that fuel vapor generated in the fuel vapor source cannot flow to the engine;

sensing an internal pressure of the fuel vapor source;

determining a rate of increase of the internal pressure of the fuel vapor source with the fuel vapor source isolated; and performing malfunction sensing of the fuel vapor control system only if the rate of increase of the internal pressure is below a prescribed value, the malfunction sensing comprising connecting the fuel vapor source to the engine via the canister, sensing the internal pressure of the fuel vapor source, and determining that the fuel vapor control system is malfunctioning if the pressure is above a prescribed level.

10. A method as claimed in claim 9 including performing malfunction sensing only if the internal pressure is below a prescribed value.

* * * * *